US006619059B1

(12) United States Patent
Johnson, Sr.

(10) Patent No.: US 6,619,059 B1
(45) Date of Patent: Sep. 16, 2003

(54) METHOD AND APPARATUS FOR COOLING AC CONDENSING COILS

(76) Inventor: Tommy A. Johnson, Sr., P.O. Box 627, Swartz, LA (US) 71281

( * ) Notice: Subject to any disclaimer, the term of this patent is extended or adjusted under 35 U.S.C. 154(b) by 0 days.

(21) Appl. No.: 10/192,197

(22) Filed: Jul. 9, 2002

(51) Int. Cl.[7] ..... F28D 3/00; F28D 5/00

(52) U.S. Cl. ..... 62/171; 62/305; 62/157; 62/158; 62/231

(58) Field of Search ..... 62/157, 171, 305, 62/158, 231

(56) References Cited

U.S. PATENT DOCUMENTS

| | | | | | |
|---|---|---|---|---|---|
| 3,872,684 | A | | 3/1975 | Scott | |
| 3,997,109 | A | * | 12/1976 | Hays | 237/8 |
| 4,028,906 | A | | 6/1977 | Gingold et al. | |
| 4,170,117 | A | | 10/1979 | Fanoe | |
| 4,182,131 | A | | 1/1980 | Marshall et al. | |
| 4,204,409 | A | | 5/1980 | Satama | |
| 4,213,306 | A | | 7/1980 | Peabody et al. | |
| 4,266,406 | A | | 5/1981 | Ellis | |
| RE31,360 | E | | 8/1983 | Manno | |
| 4,559,789 | A | * | 12/1985 | Riek | 62/157 |
| 4,685,308 | A | | 8/1987 | Welker et al. | |
| 4,827,733 | A | | 5/1989 | Dinh | |
| 4,939,907 | A | | 7/1990 | Taylor | |
| 4,974,422 | A | | 12/1990 | Docher | |
| 5,003,789 | A | | 4/1991 | Gaona et al. | |
| 5,285,651 | A | * | 2/1994 | Marine | 62/171 |
| 5,309,726 | A | | 5/1994 | Asbridge | |
| 5,419,147 | A | | 5/1995 | Cooper | |
| 5,501,269 | A | | 3/1996 | Jenkins | |
| 5,605,052 | A | * | 2/1997 | Middleton et al. | 62/171 |
| 5,701,748 | A | * | 12/1997 | Phelps et al. | 62/91 |
| 6,253,559 | B1 | * | 7/2001 | Kinkel et al. | 62/91 |
| 6,253,565 | B1 | | 7/2001 | Arledge | |
| 6,293,121 | B1 | * | 9/2001 | Labrador | 62/304 |

* cited by examiner

*Primary Examiner*—William C. Doerrler
*Assistant Examiner*—Mark Shulman
(74) *Attorney, Agent, or Firm*—Robert N. Montgomery

(57) ABSTRACT

A method and apparatus for cooling an air conditioning system's condensing coils utilizing air filter pad made of glass fibers with self contained, perforated water capillary tubes allowing moisture to permeate the filter pad. The filter dads are connectable in series and provided with integral mounting strips for fixed or magnetic, internal or external attachment to the condensing unit. Special adaptive solenoids are also provided to allow for minimum flow of water over long periods of time. Dual sensors are provided connected to both the high and low side of the compressor for sensing compressor temperature status and switching the solenoid on and off, thereby preventing freezing. A unique method for applying chilled water to the capillary tubes by coiling the capillary tube around the suction line of the compressor is utilized. The system may be provided in kits with several pads adapted for use with a wide variety of condensing unit configurations and includes valves, tubing, wiring and connection boxes, insulation components for enclosing compressor and water tubing, and detailed instructions.

20 Claims, 5 Drawing Sheets

METHOD AND APPARATUS FOR COOLING AC CONDENSING COILS

BACKGROUND OF THE INVENTION

1. Field of the Invention

This invention relates generally to water vapor cooling systems for air-cooled condensing units and more particularly to an improvement thereof.

2. General Background

Conventional air conditioning systems used for many commercial and residential dwellings utilize an outside compressor unit housing the compressor motor and the condensing coils which are normally cooled by passing a forced draft stream of ambient air through the coils.

It is generally known within the air conditioning art that an over all reduction in energy can be achieve in an air conditioning system by improving the efficiency of the condensing coils' ability to quickly dissipate heat. Therefore, numerous systems have been proposed that provide means for applying water vapor to the coils, thereby lowering the ambient temperature of the air being drawn over the coils and thus increasing the efficiency of the system.

Each of the prior art systems recognizes the need to cool the ambient air passing over the condensing coils. The prior art also seems to agree that the most effective and economical way to achieve this is by providing a water fog or spray system, located in front of the coils, activated by a solenoid valve and a preset temperature sensor. The prior art all disagrees on the precise method on how the spray system should be configured to achieve the most effective result. Since the air conditioning manufacturers have not yet incorporated such system into OEM systems, the technology has been left in the hands of the after market. It is therefore it is a prime concern that such water spray cooling systems be provided to the after market in a manner so that the air conditioner owner or AC maintenance personnel can easily install and maintain such a system. Secondly the system must also be as efficient as possible.

Problems associated with such systems in the prior art range from too much water, thereby causing debris buildup, mold and mildew, and oxidation in the units, solenoid failure and freeze ups as a result of abrupt temperature changes, to inefficiency due to lack of attention to detail in the installation process. It has been found that simply providing extra insulation to the compressor lines and cooling the spray water vastly improves efficiency. Further improvements are necessary to allow the installer to easily accommodate the wide variety of condensing unit designs without compromising the system's integrity.

SUMMARY OF THE INVENTION

A more efficient method for cooling an air conditioning system's condensing coils can be achieved by providing an air filter pad made of glass fibers with self contained, perforated water capillary tubes that allow moisture to permeate the filter pad. Pads are connectable in series and provided with integral mounting strips for fixed or magnetic internal or external attachment to the condensing unit.

Special adaptive solenoids are also provided to allow for minimum flow of water over long periods of time. Rather than relying on ambient temperature sensor for water control, dual sensors are provided connected to the high and low side of the compressor for sensing compressor temperature status and switching the solenoid on and off, thereby preventing freezing. A unique method for applying chilled water to the capillary tubes by coiling the capillary tube around the suction line of the compressor is utilized. The system may be provided in kits with several pads adapted for use with a wide variety of condensing unit configurations and includes valves, tubing, wiring and connection boxes, insulation components for enclosing compressor and water tubing, and detailed instructions.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
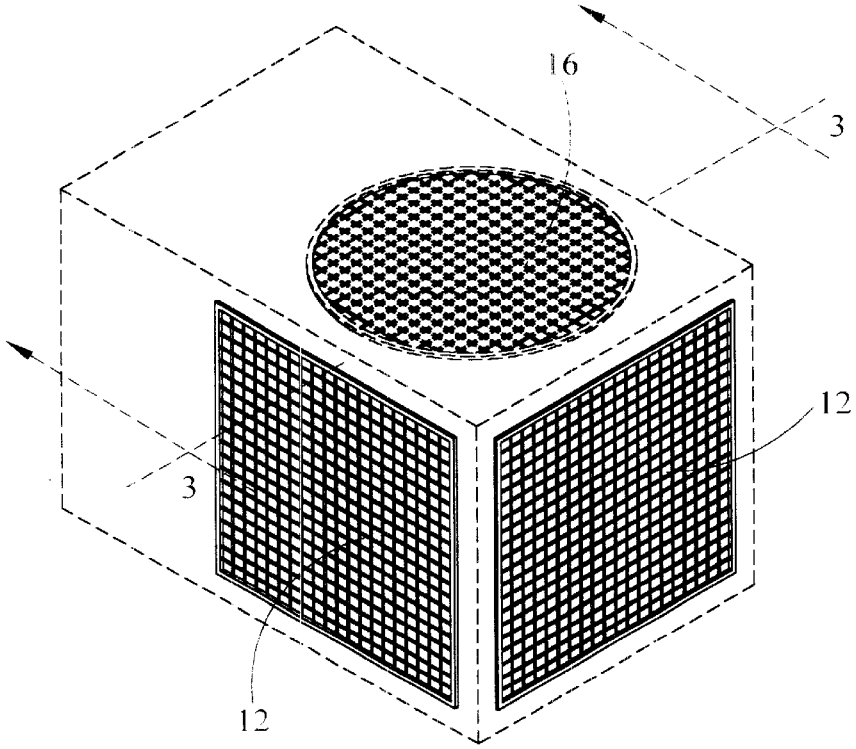
FIG. 1 is an isometric view of a typical air conditioning condensing unit.
Figure 2:
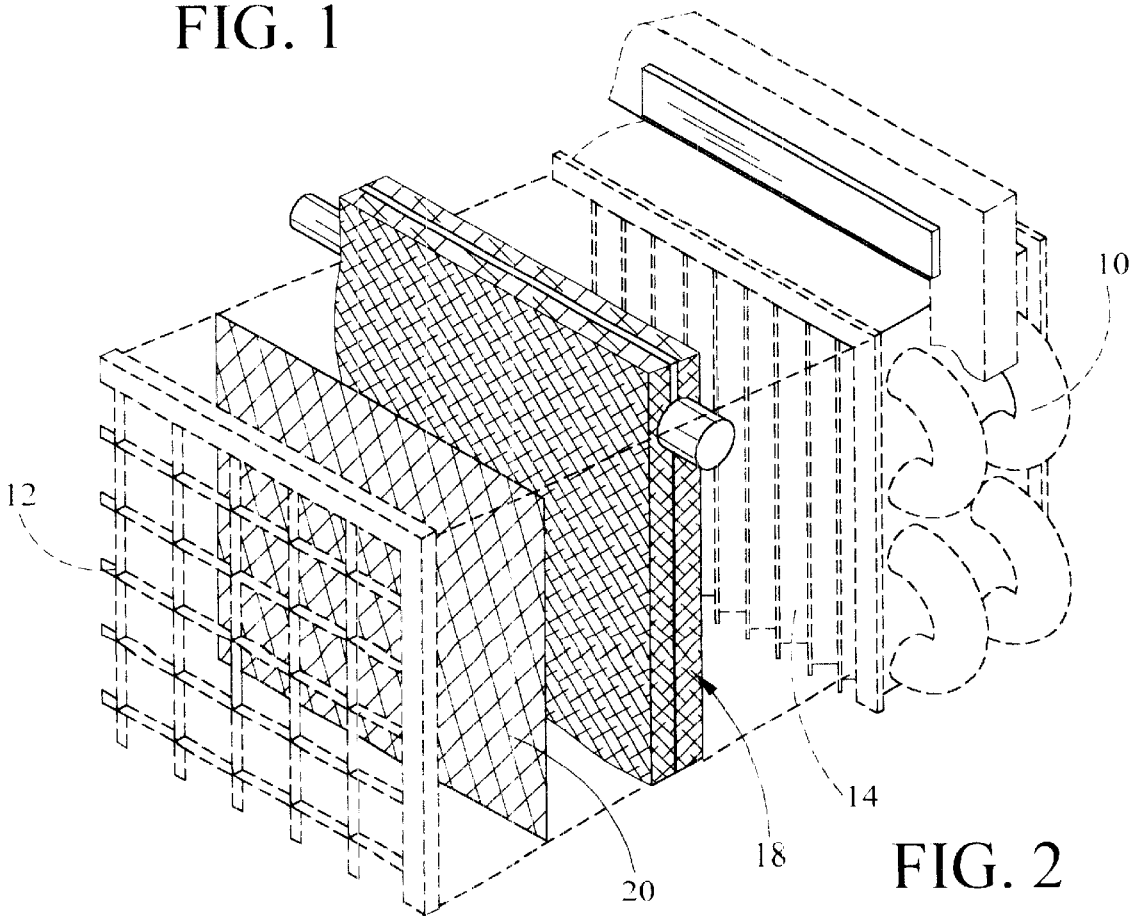
FIG. 2 is an exploded view of a typical condensing coil with a portion of the instant invention located between the condensing unit and the grill illustrated in FIG. 1.
Figure 3:
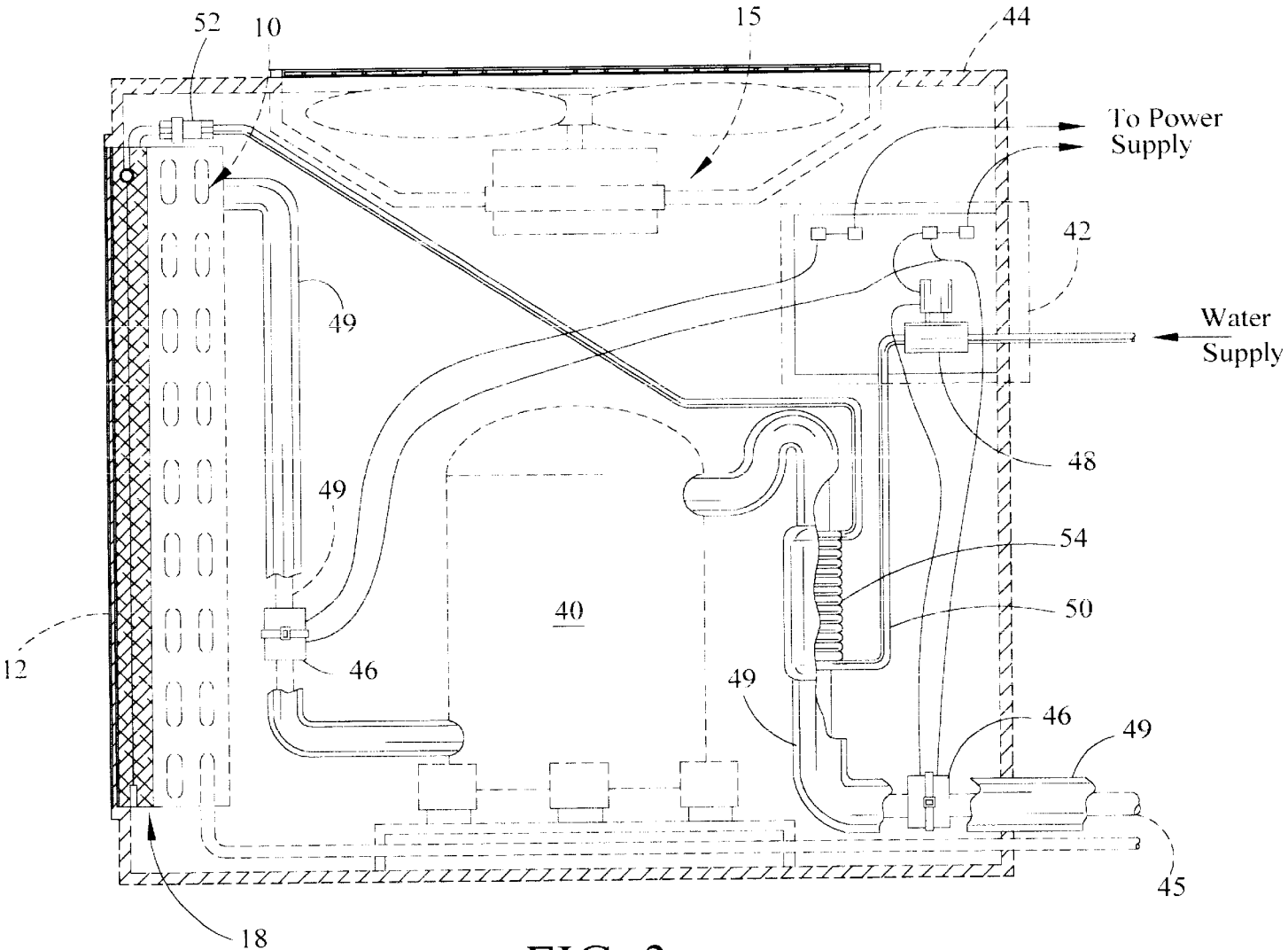
FIG. 3 is a cross section view of the condensing units taken along sight line 3—3 seen in FIG. 1.
Figure 7:
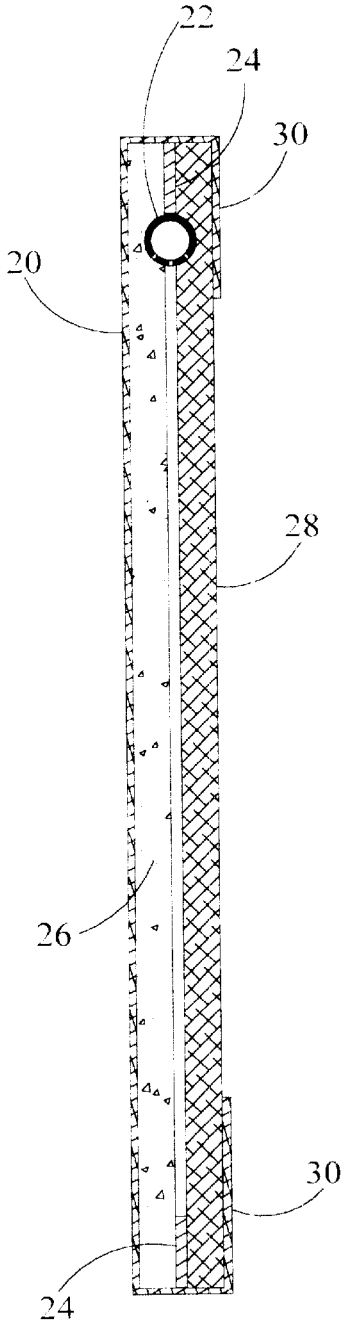
FIG. 7 is a cross section view of the filter element taken along sight line 7—7 seen in FIG. 6.
Figure 6:
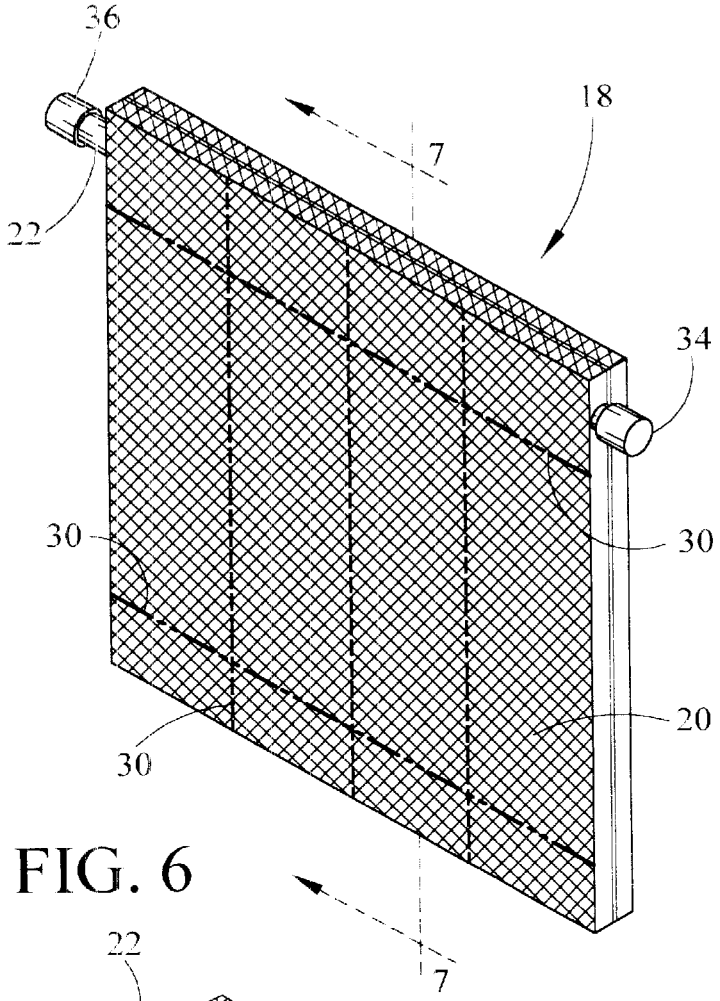
FIG. 6 is an isometric view of the filter element.
Figure 8:
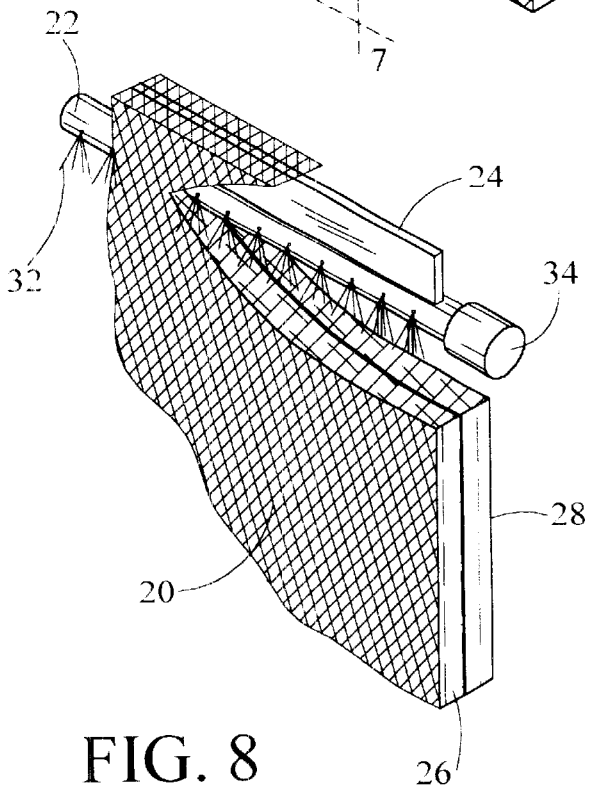
FIG. 8 is partial cross section of the filter element seen in FIG. 6 exposing the capillary tube and attachment bar.

Outdoor condensing units may take a wide variety of configurations, the most common of which is the rectangular shape seen in FIG. 1. The condensing coils 10 as seen in FIG. 2 are generally located behind one or more of the grill panels 12. The coils are generally surrounded by fins 14 that help dissipate heat from the tubes 10 as air is drawn across the coils and fins by a fan 15, seen FIG. 3, and expelled through the upper grill 16 seen in FIG. 1. The present invention utilizes a glass fiber filter pad panel 18 and includes a fine screen panel 20 located in front of the condensing coils 10 either inside or outside the grill panels 12 as seen in FIG. 2. The filter panels 18 and screen 20 may be captured between the coils 10 and the grill 12 as seen in FIG. 3. A more detailed view of the filter panels 18 may be seen in FIG. 6 wherein it maybe seen that the panel 18 is constructed by utilizing a typical laminated fiberglass mat-type air conditioning return air filter having a about 1–5 micron particle rating. One of the laminated mats may be slightly denser than the other and thereby serves as the primary or outer filter side. Usually this is indicated by a white mat (exterior mat) and a blue mat lightly adhered together to form a single panel. As seen in cross section in FIG. 7, a capillary tube comprised of a length of ¼ inch vinyl tubing 22 is attached or otherwise adhered to a metal or magnetic strip 24 and inserted between the outer filter mat 26 and the inner mat 28. The filter mat is then wrapped by the fine mesh screen 20 and adhered thereto by several lines of epoxy 30. The screen 20 also may be sewn in a manner whereby a portion of the screen 30 overlapping the filter mat 28 forms a hem enclosing the strip 24 and tubing 22. Likewise, a hem is used to enclose a second metal, preferably stainless steel, or a magnetic strip 24 located at the lower edge of the panel 18. Passing the tubing 22 through a sewing machine utilizing a fairly large gauge needle, thereby penetrating both walls of the tubing, perforates the flexible vinyl tubing 22 in a manner whereby water 32 is only expelled when under pressure as seen in FIG. 8. The flexible vinyl tubing 22 located in each panel 18 may have a removable cap or a coupling fitting 36, seen in FIG. 6, for connection to adjoining panels and to the water supply system.

The metal or magnetic strip 24 mentioned above may be utilized to attach the panel 18 to the enclosure of the condensing unit either internally or externally by fasteners or magnetic adhesion.

Looking now at FIG. 3 we see the filter panel 18 located in front of the coils 10 that are connected to the compressor 40. The water cooling system further includes the electrical control box 42, which may be mounted adjacent the electrical breaker box for the condensing unit or may be mounted as shown outside or inside the condensing unit housing 44. The control box 42 includes electrical power supply connections and connections for the temperature sensors 46, located in contact with the high and low side pressure lines leading to and from the compressor 40. It should be noted that the compressor lines are and should be fully insulated internally and externally to the condensing unit and insulation materials 49 should be provided in any water cooler kit for covering the pressure lines and the sensor elements 46. The control box 42 may include the water supply solenoid 48 or it may be mounted externally thereto. A polyethylene chill water line 50 leading from the solenoid valve 48 to its connection with one or more filter panels 18 is coiled 54 around the low pressure or suction line leading to the compressor with sufficient contact and insulated to insure that the cold suction line pre-chills the water prior to entering the filter pads 18. It is important to note that the use of Polyethylene flexible tubing for the chill water line prevents tube collapse in warm weather.

An important aspect of providing a condensing unit water cooler system in kit form is the ease and ability to conform the system to the configuration of the condensing unit, prevent the intrusion of debris into the unit without excessive air flow restriction, and the ability to clean and maintain the system.

Figure 9:
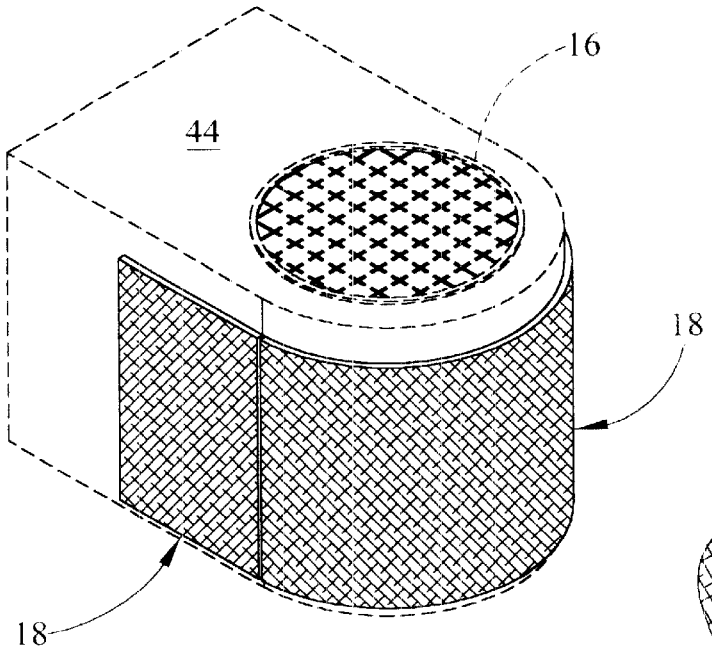
FIG. 9 is an isometric view of an alternate embodiment of semicircular condensing unit with externally adapted filter pads.
Figure 11:
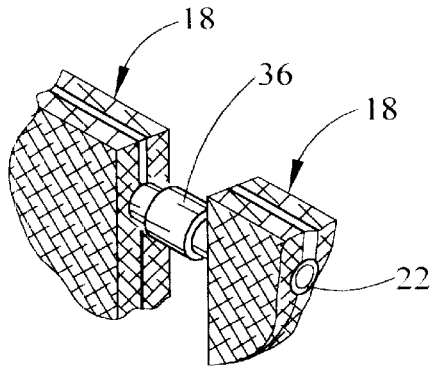
FIG. 11 is a partial isometric view of the connecting coupling for connecting the filter pads seen in FIG. 10.
Figure 10:
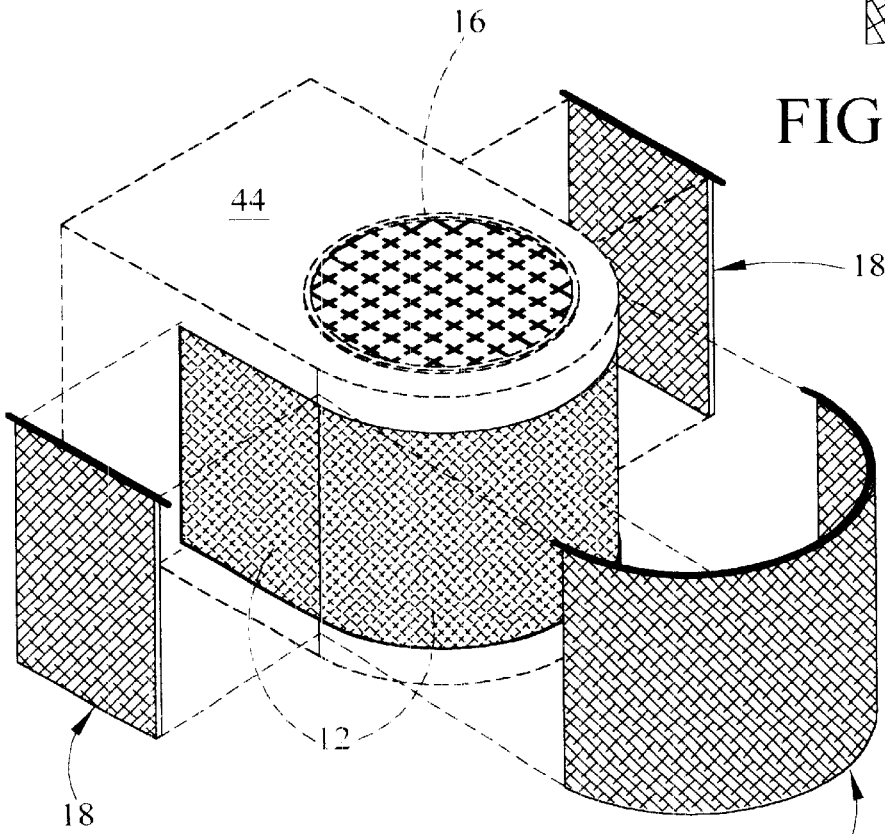
FIG. 10 is an exploded view of the condensing unit seen in FIG. 9.

As seen in FIG. 9, the filter pads 18 are flexible and thus readily contoured to almost any shape condensing unit and may be mounted externally, as seen in FIG. 10, by adherence of the metal or magnetic strips 24 directly over the grills 12, with multiple panels coupled as seen in FIG. 11 by coupling 36 of the perforated vinyl tubing 32.

Figure 4:
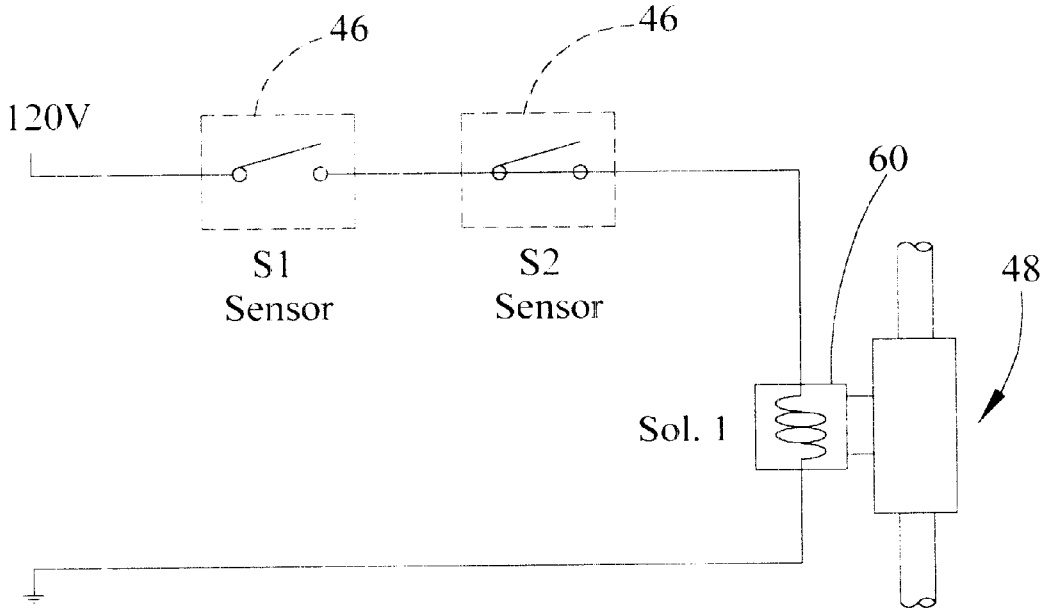
FIG. 4 is a wiring schematic.
Figure 5:
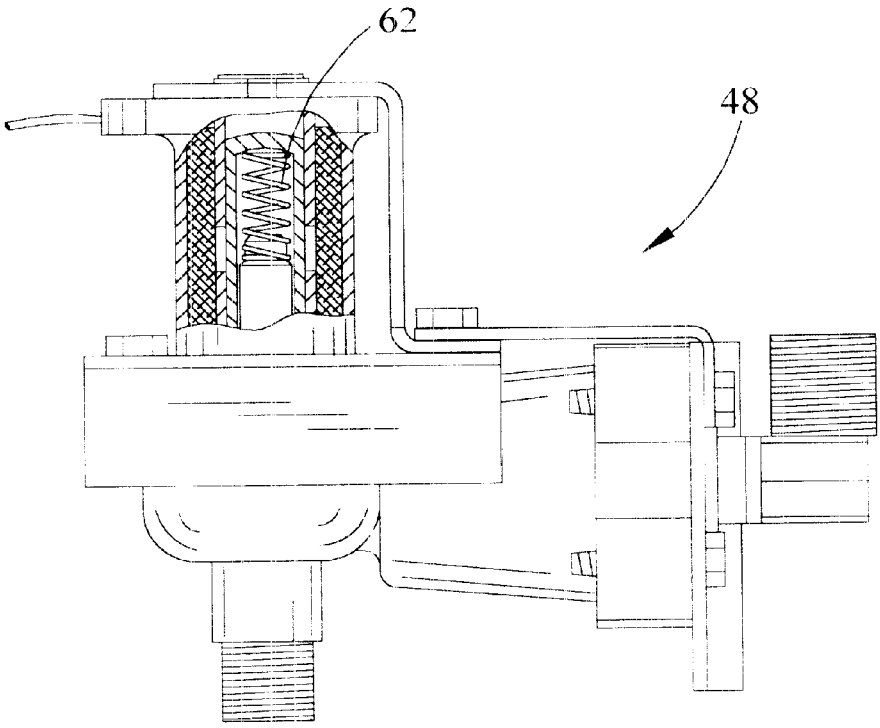
FIG. 5 is a partial cross section view of the solenoid valve exposing the valve spring.

Looking now at FIG. 4 we see that the sensors S1 and S2 located on the suction and high pressure lines of the compressor are in series with the solenoid coil 60 of the valve 48, therefore insuring that the required temperature differential must be present for operation of the solenoid 60. Since this solenoid valve may be required to remain open for long periods of time over several hours, solenoid must be rated for heavy-duty service. However, the valve spring 62 shown in FIG. 5 must allow the valve to remain partially open or partially closed at any given time. Springs normally provided with these type valves are designed to allow only normally open or normally closed operation. The preferred valve must be adapted for low voltage, preferably 24 volts, and pass only 8 to 40 ounces of water per minute at 30 to 45 PSI with a spring 62 adapted to be operated with only 0.380 Newtons or 0.0856 pounds of force.

In operation the temperature sensors 46 designated S1 and S2 and whereas S1 located on the high pressure line 43 between the compressor 40 and the condensing coil 10 is preset to make contact at 110 degree F. and open at 90 degrees F. Whereas the S2 sensor 46, located on the suction line 45, is preset to make contact at 50 degrees and open at 40 degrees. Since both sensors Si and S2 are in series, there always must be a temperature differential of between 40 and 70 degrees with optimum compressor temperature being 50–55 degrees. By monitoring the compressor pressure and suction line temperature, the system automatically prevents freezing that often occurs with cool mornings or evenings combined with hot days.

As water is forced out of the perforations in the capillary tubes 32 at such a low rate of less than 40 ounces per min, in a weeping manner the water tends to follow the strands of fiberglass in the filter pad forming a cool moist curtain rather than simply saturating the coils with water, thereby optimizing water flow. The solor or fine mesh screen further provides a barrier to prevent debris from becoming trapped in the air filter and allows for easy wash down by hose to remove any accumulation of such debris.

Water cooled condensing unit systems installed in the manner disclosed herein have been found to use 25 to 30 percent less power than the same previously non-cooled condensing unit.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A condenser coil cooling system for central air conditioners having externally located condensing and compressor units in a housing having a forced draft fan for drawing an air stream across the condensing coils comprising:

a) an air filter panel having a fine screen mesh covering one face located within said air stream leading to said condensing coils;

b) a first length of flexible polymeric tubing having a plurality of perforations attached periodically to a rigid strip inserted along one edge of said filter panel;

c) a second length of flexible polymeric tubing having one end connected to said first length of polymeric tubing, a portion of which is coiled around and in contact with refrigeration suction tubing associated with said compressor;

d) an electrical control water valve having an inlet port connected to a source of pressurized water and an outlet port connected to said second length of flexible polymeric tubing; and e) a means for electrically controlling said water valve between open and closed positions in response to preset electrical temperature sensors located in contact with both pressure and suction refrigeration lines connected to said compressor.

2. The condenser coil cooling system according to claim 1 wherein said filter panel comprises a composite panel having at lease two fiberglass mats of different density and a fine mesh screen, said screen further forming a hem along at least two edges, each said hem enclosing at least a said rigid strip.

3. The condenser coil cooling system according to claim 2 wherein said rigid strip is magnetic.

4. The condenser coil cooling system according to claim 3 wherein said rigid strip is secured externally to said housing.

5. The condenser coil cooling system according to claim 2 wherein said filter panel is located between said housing and said cooling coil.

6. The condenser coil cooling system according to claim 1 wherein said water valve is restricted to a flow of between 8 to 40 ounces per minute.

7. The condenser coil cooling system according to claim 1 wherein said water valve is fitted with a spring that requires less than 0.380 Newtons to close.

8. The condenser coil cooling system according to claim 1 wherein one of said electrical temperature sensors located in contact with said suction refrigeration line is set to electrically close said water valve at 40 degrees and open said water valve at 50 degrees Fahrenheit.

9. The condenser coil cooling system according to claim 1 wherein one of said electrical temperature sensors located in contact with said pressure refrigeration line is set to electrically close said water valve at 90 degrees and open said water valve at 110 degrees Fahrenheit.

10. The condenser coil cooling system according to claim 1 wherein said cooling system further includes insulation applied to all exposed refrigeration lines including areas where sensors and polymeric tubing make contact with such lines.

11. A condensing coil cooling system for water misting the condensing coil in a central air conditioning system having an outdoor compressor unit, a housing for said compressor unit containing a fan, an opening in said housing through which a stream of air is created flowing across said condensing coil carried within said housing adjacent said opening and extending thereover, said condensing coil receiving refrigerant fluid from a compressor having suction and pressure refrigerant lines, said apparatus comprising:

a) a control valve having an inlet port connected to a source of pressurized water;

b) an air filter panel comprising at least two plies of fiber glass non-woven mat and fine mesh screen on at least one face and a rigid strip extending along at least one edge, said filter located in the path of said stream of air flowing across said condensing coil;

c) a first length of flexible capillary tubing attached periodically along the length of said rigid strip, said tube having a plurality of perforations therein d) a second length of flexible tubing connected to said capillary tubing connected to an outlet port of said control valve for dispersing water from said source when said valve is in the open position and wherein a portion of said second length of flexible tubing is coiled around and in contact with said suction refrigerant line; and d) a means for automatically positioning said control valve to at least a partially open position in electrical response to preset temperature limits established by temperature sensors located externally on both said suction and pressure refrigerant lines leading to and from said compressor.

12. The condensing coil cooling system according to claim 11 wherein said control valve is operated by an electric solenoid and utilizes a spring requiring less than 0.0856 pounds of force to close.

13. The condensing coil cooling system according to claim 11 wherein said air filter mat comprises a composite panel having at lease two fiberglass mats of different density and a fine mesh screen, said screen further forming a hem along at least two edges, each said hem enclosing at least a said rigid strip.

14. The condensing coil cooling system according to claim 11 wherein one of said electrical temperature sensors located in contact with said suction refrigeration line is set to electrically close said water valve at 40 degrees and open said water valve at 50 degrees Fahrenheit.

15. The condensing coil cooling system according to claim 11 wherein one of said electrical temperature sensors located in contact with said pressure refrigeration line is set to electrically close said water valve at 90 degrees and open said water valve at 110 degrees Fahrenheit.

16. The condensing coil cooling system according to claim 11 wherein said capillary tube is vinyl and said second flexible tube is polyethylene.

17. The condensing coil cooling system according to claim 11 wherein said rigid strip is magnetic.

18. The condensing coil cooling system according to claim 11 wherein said filter mat is attached externally to said housing for said condensing coils.

19. The condensing coil cooling system according to claim 11 wherein said system further comprises a plurality of filter panels located in a manner whereby said capillary tubes are connected in series and arranged so that said filter panels generally intercept the air stream flowing over said condensing coils.

20. A method for enhancing heat dissipation of central air conditioner condensing unit coils connected to a compressor having pressure and suction refrigeration lines comprising the steps of:

a) providing chill water misting system comprising an electrically operated water valve having an inlet connected to a water source and an outlet connected to a first flexible tube connected to a second flexible tube having a plurality of perforations therein attached periodically to a rigid strip, said strip and second flexible tube contained within a fiber glass filter panel attached to a fine mesh screen in a manner whereby water is dispersed over the surface of said filter panel when said water valve is open, said filter panel located so as to intercept air drawn over said condensing unit coils, said system further comprising a means for electrically controlling said water valve with temperature sensors attached to said pressure and suction lines for automatically opening and closing said water valve at preset temperatures of between 40 and 50 degrees F. for said suction line and 90 to 110 degrees for said pressure line;

b) installing said system by locating said filter panels externally of said condensing coils and connecting said second flexible tube to said first flexible tube having a significant portion coiled around and in contact with said suction refrigeration line;

c) locating and mounting said water valve and means for controlling said valve;

d) attaching said temperature sensors to said refrigeration lines;

e) connecting said means for controlling to a power supply source;

f) connecting said water valve to a supply source;

g) insulating all exposed internal and external refrigeration lines including said sensors; and h) monitoring said system for operation within established temperature limits.

* * * * *